US011021659B2

(12) United States Patent
Choi et al.

(10) Patent No.: US 11,021,659 B2
(45) Date of Patent: Jun. 1, 2021

(54) ADDITIVES FOR SUPERCRITICAL WATER PROCESS TO UPGRADE HEAVY OIL

(71) Applicant: Saudi Arabian Oil Company, Dhahran (SA)

(72) Inventors: Ki-Hyouk Choi, Dhahran (SA); Emad N. Shafei, Dhahran (SA); Mohammed Zuhair Albahar, Dhahran (SA); Abdulaziz A. Ghabbani, Khobar (SA)

(73) Assignee: Saudi Arabia Oil Company

( * ) Notice: Subject to any disclaimer, the term of this patent is extended or adjusted under 35 U.S.C. 154(b) by 231 days.

(21) Appl. No.: 15/905,089

(22) Filed: Feb. 26, 2018

(65) Prior Publication Data

US 2019/0264110 A1 Aug. 29, 2019

(51) Int. Cl.

| | |
|---|---|
| ***C10G 9/00*** | (2006.01) |
| ***C10G 9/34*** | (2006.01) |
| ***C10G 53/06*** | (2006.01) |
| ***C10G 21/00*** | (2006.01) |
| ***C10G 67/06*** | (2006.01) |
| ***C10G 49/00*** | (2006.01) |
| ***C10G 21/22*** | (2006.01) |
| ***C10G 29/28*** | (2006.01) |
| ***C10G 9/36*** | (2006.01) |

(52) U.S. Cl.

CPC ..... *C10G 9/34* (2013.01); *C10G 9/36* (2013.01); *C10G 21/003* (2013.01); *C10G 21/22* (2013.01); *C10G 29/28* (2013.01); *C10G 49/007* (2013.01); *C10G 53/06* (2013.01); *C10G 67/06* (2013.01); *C10G 2300/202* (2013.01); *C10G 2300/805* (2013.01)

(58) Field of Classification Search

CPC ..... C10G 9/34; C10G 9/36; C10G 21/003; C10G 21/22; C10G 29/28; C10G 53/02; C10G 53/04; C10G 53/06; C10G 55/00; C10G 55/02

See application file for complete search history.

(56) References Cited

U.S. PATENT DOCUMENTS

| | | | |
|---|---|---|---|
| 3,989,618 | A | 11/1976 | McCollum et al. |
| 4,719,000 | A | 1/1988 | Beckberger |
| 5,954,943 | A | 9/1999 | Tong et al. |
| 7,154,016 | B2 | 12/2006 | Heller et al. |
| 7,754,067 | B2 | 7/2010 | Allam |
| 7,922,895 | B2 | 4/2011 | Banerjee |
| 8,791,314 | B2 | 7/2014 | Fremy et al. |

(Continued)

FOREIGN PATENT DOCUMENTS

| | | | |
|---|---|---|---|
| WO | 2005111175 | A1 | 11/2005 |
| WO | 2015094948 | A1 | 6/2015 |

OTHER PUBLICATIONS

Robert M. Baldwin and Stephen Vinciguerra, "Coal liquefaction catalysis: Iron pyrite and hydrogen sulphide", Fuel, vol. 62, pp. 498-501, 1983.

(Continued)

*Primary Examiner* — Prem C Singh
*Assistant Examiner* — Brandi M Doyle
(74) *Attorney, Agent, or Firm* — Bracewell LLP; Constance G. Rhebergen

(57) ABSTRACT

A method of upgrading a petroleum feedstock, the method comprising the steps of introducing a disulfide oil, a water feed, and a petroleum feedstock to a supercritical water upgrading unit, and operating the supercritical water upgrading unit to produce a product gas stream, a product oil stream, and a used water stream.

10 Claims, 4 Drawing Sheets

(56) References Cited

U.S. PATENT DOCUMENTS

| | | | | |
|---|---|---|---|---|
| 2002/0029514 | A1* | 3/2002 | Lindstrom | C10G 9/16 44/640 |
| 2005/0040081 | A1 | 2/2005 | Takahashi et al. | |
| 2008/0099374 | A1 | 5/2008 | He et al. | |
| 2008/0099376 | A1 | 5/2008 | He et al. | |
| 2008/0099377 | A1 | 5/2008 | He et al. | |
| 2008/0099378 | A1 | 5/2008 | He et al. | |
| 2008/0116112 | A1* | 5/2008 | Umansky | C10G 21/00 208/208 R |
| 2009/0016261 | A1 | 1/2009 | Laroia et al. | |
| 2009/0016262 | A1 | 1/2009 | Kulkarni et al. | |
| 2009/0032436 | A1 | 2/2009 | Takahashi et al. | |
| 2009/0145805 | A1 | 6/2009 | Choi | |
| 2016/0010003 | A1 | 1/2016 | Walters et al. | |
| 2016/0272901 | A1* | 9/2016 | Choi | C10G 47/32 |
| 2016/0312129 | A1* | 10/2016 | Choi | C10G 47/32 |
| 2017/0166821 | A1 | 6/2017 | Choi et al. | |
| 2017/0240819 | A1 | 8/2017 | Snow et al. | |

OTHER PUBLICATIONS

Bricker et al., "Advances in Merox Process and Catalysis for Thiol Oxidation", Topics in Catalysis, 2012, pp. 1315-1323, vol. 55, Springer.

The International Search Report and Written Opinion for related PCT application PCT/US2019/019498 dated May 15, 2019.

Katritzky et al., "Aqueous High-Temperature Chemistry of Carbo- and Heterocycles. 21. Reactions of Sulfur-Containing Compounds in Supercritical Water at 460 C", Energy & Fuels, 1994, pp. 498-506, American Chemical Society.

* cited by examiner

ADDITIVES FOR SUPERCRITICAL WATER PROCESS TO UPGRADE HEAVY OIL

TECHNICAL FIELD

Disclosed are methods for upgrading petroleum. Specifically, disclosed are methods and systems for upgrading petroleum using aliphatic sulfur compounds.

BACKGROUND

Radical reactions are a commonly adopted way for upgrading and cleaning hydrocarbons to improve quality with high yield. Upgrading hydrocarbons results in production of lighter hydrocarbons from heavier hydrocarbon feedstock. Cleaning of hydrocarbons results in separation of heteroatoms such as sulfur, nitrogen, oxygen, and metals from hydrocarbons in the form of gases such as hydrogen sulfide ($H_2S$), ammonia ($NH_3$), water ($H_2O$) and metal compounds such as vanadium oxide and vanadium oxysulfide through chemical reactions.

One upgrading process which employs radical reactions is the thermal cracking process. Thermal cracking processes include coking and visbreaking. In radical chain reactions, generally, the initiation step requires the highest energy, because a lot of energy is needed to break carbon-carbon bonds to generate radicals. Cracking large molecules into smaller molecules, by breaking the carbon-carbon bonds, generates valuable liquid fuels, such as gasoline and diesel, but such high energy results in easy recombination and oligomerization of hydrocarbon radicals to produce solid coke. In most refineries, coke and gas products from thermal cracking processes have very low economic values.

An alternate upgrading process employs hydrogen addition in the presence of a catalyst to meet target production yields and quality. The catalytic hydrogen addition process has higher yield of liquid product and better quality than thermal cracking processes. Catalytic hydrogen addition processes have strict limitations on feedstock properties. For example, a feedstock containing large amounts of metals such as vanadium cannot be processed by catalytic hydrogen addition processes without frequently changing the catalyst bed due to accelerated deactivation by deposition of metals on the catalyst.

Thus, although thermal cracking processes can accept a wider range of feedstock than catalytic hydrogen addition processes, the liquid yield and quality of liquid product are reduced.

SUMMARY

Disclosed are methods for upgrading petroleum. Specifically, disclosed are methods and systems for upgrading petroleum using aliphatic sulfur compounds.

In a first aspect, a method of upgrading a petroleum feedstock is provided. The method includes the steps of introducing a disulfide oil, a water feed, and a petroleum feedstock to a supercritical water upgrading unit, and operating the supercritical water upgrading unit to produce a product gas stream, a product oil stream, and a used water stream.

In certain aspects, the step of operating the supercritical water upgrading unit to produce the product gas stream, the product oil stream, and the used water stream includes the steps of mixing a disulfide oil and a petroleum feedstock in a petroleum mixer to produce a mixed petroleum stream, introducing the mixed petroleum stream to a petroleum pump, increasing the pressure of the mixed petroleum stream to produce a pressurized petroleum stream, introducing the pressurized petroleum stream to a petroleum heater, increasing the temperature of the pressurized petroleum stream to produce a hot petroleum stream, mixing the hot petroleum stream and a supercritical water stream to produce a mixed feed, introducing the mixed feed to a supercritical water reactor, allowing conversion reactions to occur in the supercritical water reactor to produce a modified stream, introducing the modified stream to a cooling device, reducing the temperature of the modified stream in the cooling device to produce a cooled stream, introducing the cooled stream to a depressurizing device, reducing the pressurizing in the depressurizing device to produce a discharged stream, introducing the discharged stream to a gas-liquid separator, separating the discharged stream in the gas-liquid separator to produce a product gas stream and a liquid phase stream, introducing the liquid phase stream to an oil-water separator, and separating the liquid phase stream in the oil-water separator to produce a product oil stream and a used water stream. In certain aspects, the method further includes the steps of introducing the product oil stream to a fractionator, separating the product oil stream into a light fraction and a heavy fraction, introducing the light fraction to a disulfide oil unit, and producing a sweetened light fraction and the disulfide oil. In certain aspects, the disulfide oil unit is a merox unit. In certain aspects, the method further includes the step of mixing the sweetened light fraction and the heavy fraction to produce an upgraded oil product. In certain aspects, the method further includes the step of introducing a disulfide oil unit feed to a disulfide oil unit, where the disulfide oil unit feed is selected from the group consisting of natural gas, LPG, naphtha, and kerosene, and producing the disulfide oil in the disulfide oil unit, where the disulfide oil unit is a caustic extraction process. In certain aspects, the petroleum feedstock is selected from the group consisting of an atmospheric residue, a vacuum residue, a vacuum gas oil, and a deasphalted oil. In certain aspects, the disulfide oil includes greater than 30% by weight total paraffinic sulfur content, including the sulfur in disulfides. In certain aspects, the disulfide oil includes greater than 50% by weight disulfides. In certain aspects, the product oil stream includes an increased amount of upgraded hydrocarbons relative to petroleum feedstock. In certain aspects, the total sulfur content of mixed petroleum stream is in the range from between 0.05% by weight to 3% by weight greater than the total sulfur content in the petroleum feedstock.

In a second aspect, a system for upgrading a petroleum feedstock is provided. The system includes a disulfide oil unit operable to produce a disulfide oil from a disulfide oil feed, where the disulfide oil includes disulfides, and a supercritical water upgrading unit operable to produce a product gas stream, a product oil stream, and a used water stream.

In certain aspects, the supercritical water upgrading unit includes a petroleum mixer operable to mix the disulfide oil and a petroleum feedstock to produce a mixed petroleum stream, a petroleum pump operable to increase the pressure of the mixed petroleum stream to produce a pressurized petroleum stream, a petroleum heater operable to increase the temperature of the pressurized petroleum stream to produce a hot petroleum stream, a mixer operable to mix the hot petroleum stream and a supercritical water stream to produce a mixed feed, a supercritical water reactor operable to produce a modified stream, where conversion reactions occur in the supercritical water reactor, a cooling device operable to reduce the temperature of the modified stream to produce a cooled stream, a depressurizing device operable to reduce the pressure of the cooled stream to produce a discharged stream, a gas-liquid separator operable to separate the discharged stream to produce a product gas stream and a liquid phase stream, and an oil-water separator operable to separate the liquid phase stream to produce a product oil stream and a used water stream. In certain aspects, the system further includes a fractionator operable to separate the product oil stream into a light fraction and a heavy fraction, where the light fraction is introduced to the disulfide oil unit as the disulfide oil unit feed. In certain aspects, the disulfide oil unit is a caustic extraction process.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

Figure 1:
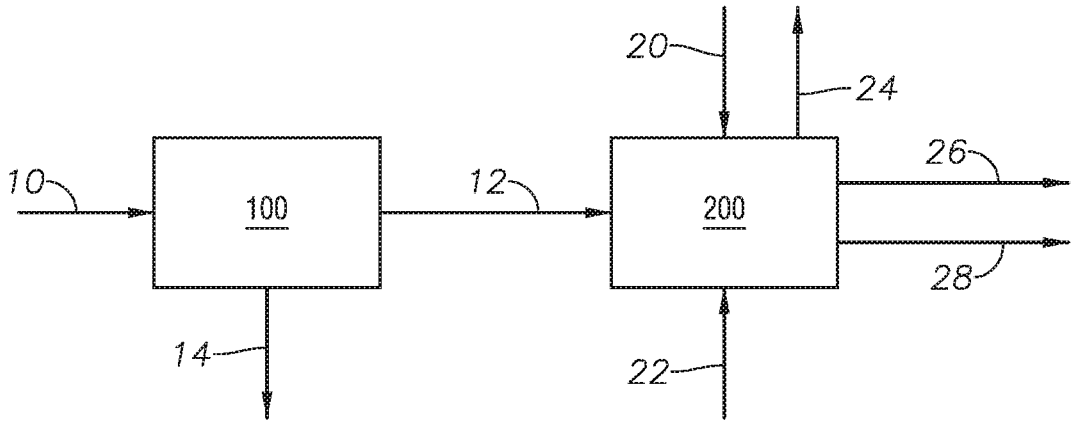
FIG. 1 provides a process diagram of an embodiment of the process.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

Described here are processes and systems of an supercritical upgrading process using added aliphatic sulfur compounds, such as disulfides as a promoter. Advantageously, aliphatic sulfur compounds enhance the radical reaction and the hydrogen transfer reactions of hydrocarbons in supercritical water environment. Advantageously, petroleum upgraded in the presence of aliphatic sulfur compounds results in a greater increase in API gravity, increased desulfurization, increased demetallization, and reduced formation of olefinic compounds as compared to petroleum upgraded without added aliphatic sulfur compounds. Advantageously, the supercritical upgrading process results in improved refining margins.

It is known in the art that hydrocarbon reactions in supercritical water upgrade heavy oil and crude oil containing sulfur compounds to produce products that have greater amounts of light fractions. Supercritical water has unique properties making it suitable for use as a petroleum reaction medium where the reaction objectives can include conversion reactions, desulfurization reactions denitrogenation reactions, and demetallization reactions. Supercritical water is water at a temperature at or greater than the critical temperature of water and at a pressure at or greater than the critical pressure of water. The critical temperature of water is 373.946° C. The critical pressure of water is 22.06 megapascals (MPa). Advantageously, at supercritical conditions water acts as both a hydrogen source and a solvent (diluent) in conversion reactions, desulfurization reactions and demetallization reactions and a catalyst is not needed. Hydrogen from the water molecules is transferred to the hydrocarbons through direct transfer or through indirect transfer, such as the water gas shift reaction.

Without being bound to a particular theory, it is understood that the basic reaction mechanism of supercritical water mediated petroleum processes is the same as a free radical reaction mechanism. Radical reactions include initiation, propagation, and termination steps. With hydrocarbons, especially heavy molecules such as C10+, initiation is the most difficult step. Initiation requires the breaking of chemical bonds. The bond energy of carbon-carbon bonds is about 350 kJ/mol, while the bond energy of carbon-hydrogen is about 420 kJ/mol, both of which are considered high chemical bond energies. Due to the high chemical bond energies, carbon-carbon bonds and carbon-hydrogen bonds do not break easily at the temperatures in a supercritical water process, 380 deg C. to 450 deg C., without catalyst or radical initiators. In contrast, carbon-sulfur bonds have a bond energy of about 250 kJ/mol. Aliphatic carbon-sulfur bond, such as thiols, sulfides, and disulfides, has a lower bond energy than the aromatic carbon-sulfur bond.

Thermal energy creates radicals through chemical bond breakage. Supercritical water creates a "cage effect" by surrounding the radicals. The radicals surrounded by water molecules cannot react easily with each other, and thus, intermolecular reactions that contribute to coke formation are suppressed. The cage effect suppresses coke formation by limiting inter-radical reactions. Supercritical water, having low dielectric constant, dissolves hydrocarbons and surrounds radicals to prevent the inter-radical reaction, which is the termination reaction resulting in condensation (dimerization or polymerization). Because of the barrier set by the supercritical water cage, hydrocarbon radical transfer is more difficult in supercritical water as compared to compared to conventional thermal cracking processes, such as delayed coker, where radicals travel freely without such barriers.

Sulfur compounds released from sulfur-containing molecules can be converted to $H_2S$, mercaptans, and elemental sulfur. Without being bound to a particular theory, it is believed that hydrogen sulfide is not "stopped" by the supercritical water cage due its small size and chemical structure similar to water ($H_2O$). Hydrogen sulfide can travel freely through the supercritical water cage to propagate radicals and distribute hydrogen. Hydrogen sulfide can lose its hydrogen due to hydrogen abstraction reactions with hydrocarbon radicals. The resulting hydrogen-sulfur (HS) radical is capable of abstracting hydrogen from hydrocarbons which will result in formation of more radicals. Thus, $H_2S$ in radical reactions acts as a transfer agent to transfer radicals and abstract/donate hydrogen.

As previously noted, aromatic sulfur compounds are more stable in supercritical water compared to more active aliphatic sulfur compounds. As a result, a feedstock having more aliphatic sulfur can have a higher activity in supercritical water. Organic disulfides, such as diethyl disulfide, has a similar bond dissociation energy (S—S bond) as a C—S bond. Decomposition of one mole of organic disulfide can generate two moles of sulfur compounds, such as hydrogen sulfide, which means labile organic disulfide is a useful precursor for hydrogen sulfide in supercritical water.

Aliphatic sulfur compounds are generally found in light naphtha and vacuum residue. In vacuum residue, aliphatic carbon-sulfur bonds are believed to be present in asphalthenic fraction. The amount of aliphatic sulfur compounds is less than aromatic sulfur compounds in common crude oils. Thus, it is required to find an aliphatic sulfur rich stream in refinery as an additive to enhance supercritical water process performance in heavy oil upgrading.

As used throughout, "external supply of hydrogen" refers to the addition of hydrogen to the feed to the reactor or to the reactor itself. For example, a reactor in the absence of an external supply of hydrogen means that the feed to the reactor and the reactor are in the absence of added hydrogen, gas ($H_2$) or liquid, such that no hydrogen (in the form $H_2$) is a feed or a part of a feed to the reactor.

As used throughout, "external supply of catalyst" refers to the addition of catalyst to the feed to the reactor or the presence of a catalyst in the reactor, such as a fixed bed catalyst in the reactor. For example, a reactor in the absence of an external supply of catalyst means no catalyst has been added to the feed to the reactor and the reactor does not contain a catalyst bed in the reactor.

As used throughout, "atmospheric residue" or "atmospheric residue fraction" refers to the fraction of oil-containing streams having an initial boiling point (IBP) of 650 deg F., such that all of the hydrocarbons have boiling points greater than 650 deg F. and includes the vacuum residue fraction. Atmospheric residue can refer to the composition of an entire stream, such as when the feedstock is from an atmospheric distillation unit, or can refer to a fraction of a stream, such as when a whole range crude is used.

As used throughout, "vacuum residue" or "vacuum residue fraction" refers to the fraction of oil-containing streams having an IBP of 1050 deg F. Vacuum residue can refer to the composition of an entire stream, such as when the feedstock is from a vacuum distillation unit or can refer to a fraction of stream, such as when a whole range crude is used.

As used throughout, "asphaltene" refers to the fraction of an oil-containing stream which is not soluble in a n-alkane, particularly, n-heptane.

As used throughout, "heavy fraction" refers to the fraction in the petroleum feed having a true boiling point (TBP) 10% that is equal to or greater than 650 deg F. (343 deg C.), and alternately equal to or greater than 1050 deg F. (566 deg C.). Examples of a heavy fraction can include the atmospheric residue fraction or vacuum residue fraction. The heavy fraction can include components from the petroleum feed that were not converted in the supercritical water reactor. The heavy fraction can also include hydrocarbons that were dimerized or oligomerized in the supercritical water reactor due to either lack of hydrogenation or resistance to thermal cracking.

As used throughout, "light fraction" refers to the fraction in the petroleum feed that is not considered the heavy fraction. For example, when the heavy fraction refers to the fraction having a TBP 10% that is equal to or greater than 650 deg F. the light fraction has a TBP 90% that is less than 650 deg F. For example, when the heavy fraction refers to the fraction having a TBP 10% equal to or greater than 1050 deg F. the light fraction has a TBP 90% that is less than 1050 deg F.

As used throughout, "light naphtha" refers to the fraction in the petroleum feed having a boiling point T90% less 240 deg C.

As used throughout, "distillable fraction" or "distillate" refers to the hydrocarbon fraction lighter than the distillation residue from an atmospheric distillation process or a vacuum distillation process.

As used throughout, "coke" refers to the toluene insoluble material present in petroleum.

As used throughout, "cracking" refers to the breaking of hydrocarbons into smaller ones containing few carbon atoms due to the breaking of carbon-carbon bonds.

As used throughout, "upgrade" means one or all of increasing API gravity, decreasing the amount of impurities, such as sulfur, nitrogen, and metals, decreasing the amount of asphaltene, and increasing the amount of distillate in a process outlet stream relative to the process feed stream. One of skill in the art understands that upgrade can have a relative meaning such that a stream can be upgraded in comparison to another stream, but can still contain undesirable components such as impurities. Such upgrading results in increase of API gravity, shifting distillation curve to lower temperature, decrease of asphalthene content, decrease of viscosity, and increase of light fractions such as naphtha and diesel.

As used here, "conversion reactions" refers to reactions that can upgrade a hydrocarbon stream including cracking, isomerization, alkylation, dimerization, aromatization, cyclization, desulfurization, denitrogenation, deasphalting, and demetallization.

As used here "mercaptan" or "thiol" refers to a compound with a carbon-sulfur bond in the form R—SH, where R can have a carbon number of 1 for a mercaptan (in the form $CH_3SH$) and R can have a carbon number between 2 and 12, and alternately between 2 and 6.

As used here, "disulfide" refers to aliphatic, organic, sulfur-containing compounds taking the form Ci-SS-Cj, where i can be selected from 1, 2, 3, 4, 5, and 6; where j can be selected from 1, 2, 3, 4, 5, and 6 and having a boiling point in the range from 100 deg C. to 306 deg C. In at least one embodiment, the disulfides can take the form Ci-SS-Cj, where i can be selected from 1, 2, 3, and 4; where j can be selected from 1, 2, 3, and 4.

The following embodiments, provided with reference to the figures, describe the upgrading process.

Referring to FIG. 1, a process flow diagram of an upgrading process is provided. Disulfide oil unit feed 10 is introduced to disulfide oil unit 100. Disulfide oil unit feed 10 can be selected from any stream containing thiol compounds. Disulfide unit feed 10 can contain between 10 wt ppm sulfur and 10,000 wt ppm sulfur. Disulfide oil unit feed 10 can include natural gas, LPG, naphtha, and kerosene. The disulfide oil unit 100 can include a caustic extraction process. In at least one embodiment, the caustic extraction process is a Merox process.

A Merox process is a desulfurization process. In general, a Merox process can remove sulfur from natural gas, LPG, and naphtha. Mercaptans present in a diesel fraction or heavier fraction cannot be treated by MEROX because those factions have low miscibility with caustic solutions, and thus have phase transfer limitations. The following reactions occur in a Merox unit:

$$2RSH+2NaOH \rightarrow 2NaSR+2H_2O \quad \text{Reaction (1)}$$

$$4NaSR+O_2+2H_2O \rightarrow 2RSSR+4NaOH \quad \text{Reaction (2)}$$

Where RSH represents a mercaptan (where R represents a radical group containing at least one carbon), NaOH is sodium hydroxide, NaSR is a sodium bonded to an $SR^-$ ion, where the R is an alkyl group, $H_2O$ is water, $O_2$ is oxygen, and RSSR represents a disulfide.

Figure 2:
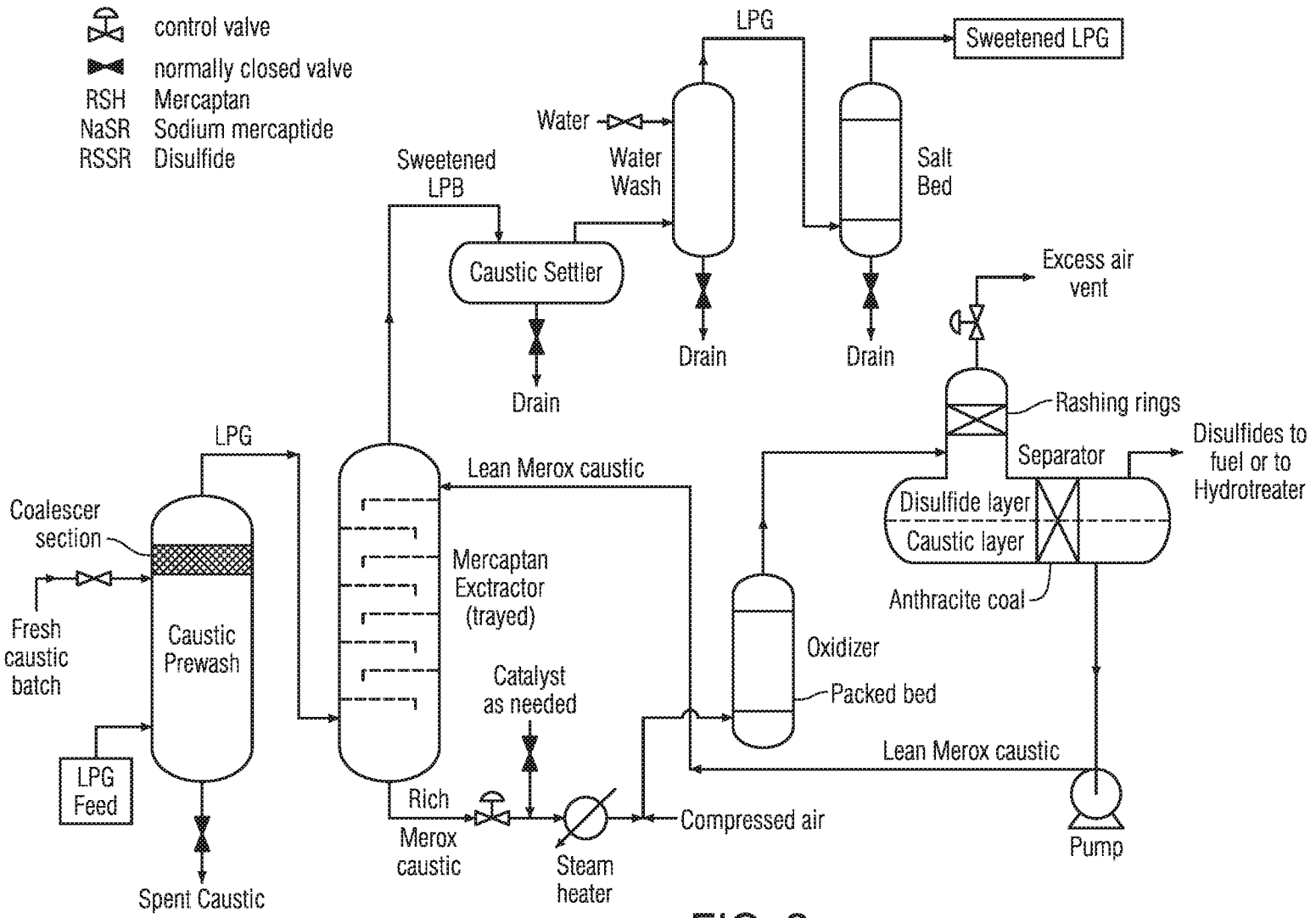
FIG. 2 (Prior Art)
FIG. 2 provides a prior art process diagram of a merox process.

In a Merox process, a caustic solution containing sodium hydroxide reacts with a thiol to form NaSR, which is extracted to a water phase. The NaSR can then be reacted with oxygen to form a water insoluble disulfide and sodium hydroxide. The sodium hydroxide can be recycled to the front of the process. The disulfide oil can be separated from the caustic solution and air by a phase separator. An embodiment of a Merox process is shown in FIG. 2.

Returning to FIG. 1, disulfide oil unit 100 can process disulfide oil unit feed 10 to produce disulfide oil 12 and sweetened light fraction 14. Disulfide oil 12 can contain disulfides containing C1 to C3 groups, C1 to C4 groups, C1 to C5 groups, C1 to C6 groups, and combinations of the same. Disulfide oil 12 can contain greater than 50 percent (%) by weight disulfides, alternately greater than 55% by weight disulfides, alternately greater than 60% by weight disulfides, alternately greater than 65% by weight disulfides, alternately greater than 70% by weight disulfides, alternately greater than 75% by weight disulfides, and alternately greater than 80% by weight disulfides. Disulfide oil 12 can have a total sulfur content of greater than 30% by weight, alternately greater than 35% by weight, alternately greater than 40% by weight, alternately between 40% by weight and 50% by weight, and alternately between 45% by weight and 50% by weight. The sodium content in disulfide oil 12 is less than 50 parts-per-million by weight (wt ppm), alternately less than 40 wt ppm, alternately less than 30 wt ppm, alternately less than 20 wt ppm, and alternately less than 10 wt ppm. Maintaining a sodium content in disulfide oil 12 of less than 50 wt ppm reduces or eliminates alkali precipitation in supercritical water reactor 240. Advantageously, disulfides are more manageable to process than hydrogen sulfide, because hydrogen sulfide is difficult to compress to supercritical water conditions and can be difficult to handle. In contrast, disulfides are safely handled and can mix within the hydrocarbon stream at supercritical water conditions. In at least one embodiment, disulfide oil 12 can contain disulfides, trisulfides, mercaptans, alkanes, alkenes, and combinations of the same. In at least one embodiment, disulfide oil 12 can further contain other hydrocarbons.

Sweetened light fraction 14 contains hydrocarbons from disulfide oil unit feed 10. Sweetened light fraction 14 contains less than 50 wt ppm sulfur and alternately less than 10 wt ppm sulfur.

Petroleum feedstock 22 is introduced to supercritical water upgrading unit 200. Petroleum feedstock 22 can be any heavy oil source derived from petroleum, coal liquid, or biomaterials. Examples of petroleum feedstock 22 can include whole range crude oil, distilled crude oil, residue oil, atmospheric residue, vacuum residue, vacuum gas oil, deasphalted oil, topped crude oil, refinery streams, product streams from steam cracking processes, liquefied coals, liquid products recovered from oil or tar sands, bitumen, oil shale, asphalthene, liquid hydrocarbons recovered from gas-to-liquid (GTL) processes, and biomass derived hydrocarbons. In at least one embodiment, petroleum feedstock 22 can include an atmospheric residue, a vacuum residue, a vacuum gas oil, and a deasphalted oil. "Whole range crude oil" refers to passivated crude oil which has been processed by a gas-oil separation plant after being recovered from a production well. "Topped crude oil" can also be known as "reduced crude oil" and refers to a crude oil having no light fraction, and would include an atmospheric residue stream or a vacuum residue stream. "Refinery streams" can include "cracked oil," such as light cycle oil, heavy cycle oil, and streams from a fluid catalytic cracking unit (FCC), such as slurry oil or decant oil, a heavy stream from hydrocracker with a boiling point greater than 650 deg F., a deasphalted oil (DAO) stream from a solvent extraction process, and a mixture of atmospheric residue and hydrocracker bottom fractions.

Water feed 20 is introduced to supercritical water upgrading unit 200. Water feed 20 can be a demineralized water having a conductivity less than 1.0 microSiemens per centimeter (μS/cm), alternately less 0.5 μS/cm, and alternately less than 0.1 μS/cm. In at least one embodiment, water feed 20 is demineralized water having a conductivity less than 0.1 μS/cm. Water feed 20 can have a sodium content less than 5 micrograms per liter (μg/L) and alternately less than 1 μg/L. Water feed 20 can have a chloride content less than 5 μg/L and alternately less than 1 μg/L. Water feed 20 can have a silica content less than 3 μg/L.

Disulfide oil 12, petroleum feedstock 22, and water feed 20 can be processed in supercritical water upgrading unit 200 to produce product gas stream 24, product oil stream 26, and used water stream 28.

Product gas stream 24 can include light gases and light hydrocarbons. Light gases can include carbon dioxide, carbon monoxide, hydrogen, ammonia, and combinations of the same. Light hydrocarbons can include methane, ethane, ethylene, propane, propylene, butane, butene, pentane, pentene, hexane, and hexane.

Product oil stream 26 can contain upgraded hydrocarbons relative to petroleum feedstock 22. Product oil stream 26 can contain less than 200 wt ppm water. Product oil stream 26 can be subjected to additional dehydration processes to remove water if needed to achieve a water content of less than 200 wt ppm. An example of a dehydration process is an electrostatic dehydrator.

Used water stream 28 can be treated and after treatment, can be disposed or recycled to the front end of the process.

Figure 3:
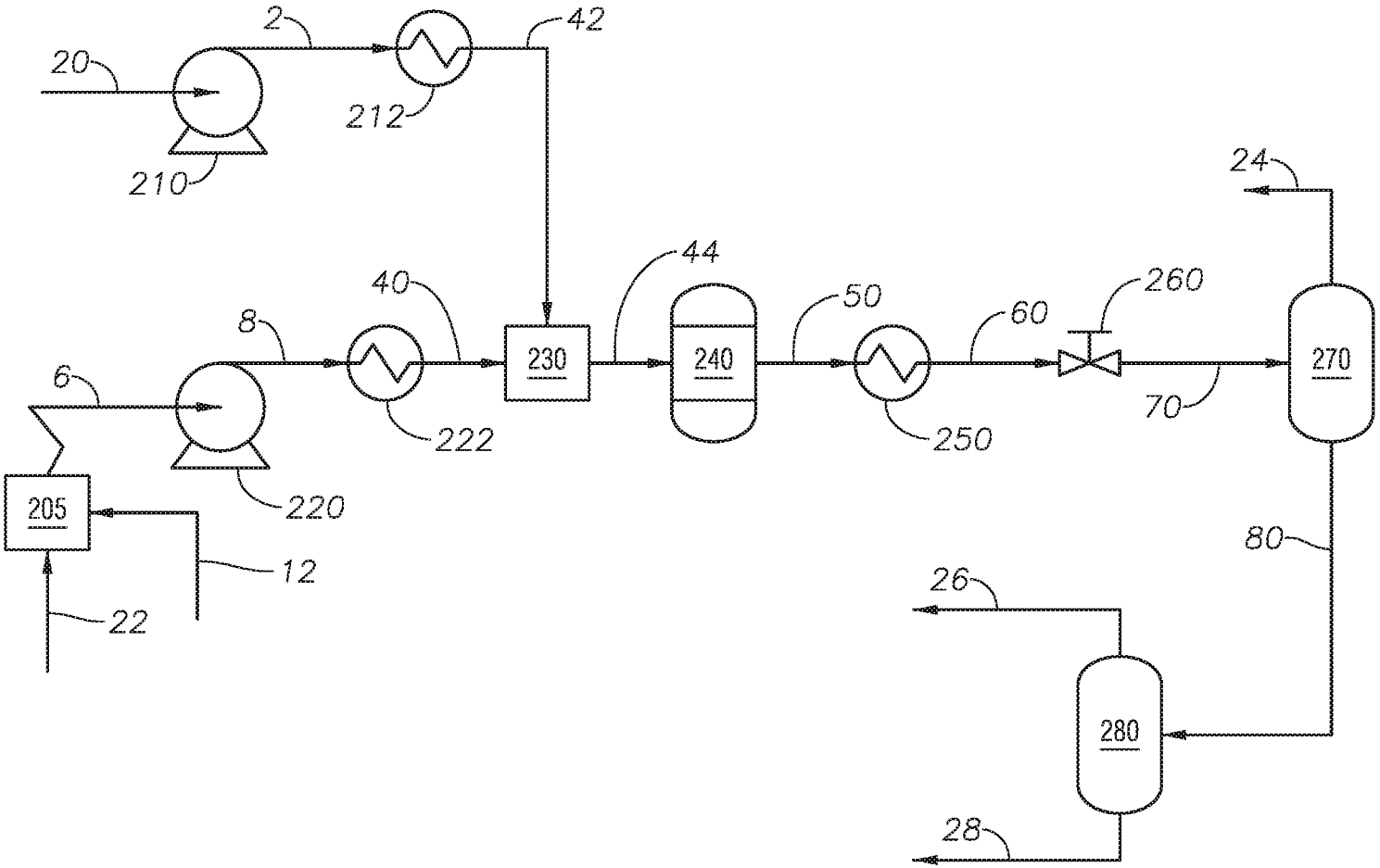
FIG. 3 provides a process diagram of an embodiment of the process.

Supercritical water upgrading unit 200 can be described in more detail with reference to FIG. 3.

Disulfide oil 12 and petroleum feedstock 22 can be mixed in petroleum mixer 205 to produce mixed petroleum stream 6. The amount of disulfide oil 12 can be determined based on the need to increase the total sulfur content in mixed petroleum stream 6. The total sulfur content of mixed petroleum stream 6 compared to the total sulfur content of petroleum feedstock 22 can be increased by between 0.05% by weight and 3% by weight and alternately between 0.1% by weight and 0.5% by weight. The concentration of paraffinic sulfur, such as thiols, in mixed petroleum stream 6 can be greater than 30 wt %. Mixing disulfide oil 12 and petroleum feedstock 22 can ensure the mixing of the disulfides in the petroleum feedstock and result in a more uniform mixed petroleum stream 6 as compared to introducing disulfide oil 12 directly to supercritical water reactor 240. Advantageously, mixing disulfide oil 12 with petroleum feedstock 22 means the disulfides produce hydrogen sulfide in the vicinity of the hydrocarbons in petroleum feedstock 22, which increases the upgrading of those hydrocarbons during the reactions in supercritical water. Injecting disulfide oil 12 separately from petroleum feedstock 22 and directly to the supercritical water reactor can result in production of hydrogen sulfide with little impact on upgrading the other hydrocarbons.

Mixed petroleum stream 6 can be passed to petroleum pump 220. Petroleum pump 220 can be any type of pump capable of increasing the pressure of mixed petroleum stream 6. In at least one embodiment, petroleum pump 220 is a diaphragm metering pump. The pressure of mixed petroleum stream 6 can be increased in petroleum pump 220 to a pressure greater than the critical pressure of water to produce pressurized petroleum stream 8. Pressurized petroleum stream 8 can be passed to petroleum heater 222.

Petroleum heater 222 can be any type of heat exchanger capable increasing the temperature of pressurized petroleum stream 8. Examples of heat exchangers capable of being used as petroleum heater 222 can include an electric heater, a fired heater, and a cross exchanger. In at least one embodiment, petroleum heater 222 can be cross exchanged with modified stream 50. The temperature of pressurized petroleum stream 8 can be increased in petroleum heater 222 to produce hot petroleum stream 40. The temperature of hot petroleum stream 40 can be between 10 degrees Celsius (deg C.) and 300 deg C. and alternately between 50 deg C. and 200 deg C. Maintaining the temperature of hot petroleum stream 40 at less than 300 deg C. reduces the formation of coke in hot petroleum stream 40 and in supercritical water reactor 240.

Water feed 20 can be passed to water pump 210. Water pump 210 can be any type of pump capable of increasing the pressure of water feed 20. In at least one embodiment, water pump 210 is a diaphragm metering pump. The pressure of water feed 20 can be increased in water pump 210 to produce pressurized water 2. The pressure of pressurized water 2 can be greater than the critical pressure of water. Pressurized water 2 can be introduced to water heater 212.

Water heater 212 can be any type of heat exchanger capable of increasing the temperature of pressurized water 2. Examples of heat exchangers that can be used as water heater 212 can include an electric heater and a fired heater. The temperature of pressurized water 2 can be increased in water heater 212 to produce supercritical water stream 42. The temperature of supercritical water stream 42 can be equal to or greater than the critical temperature of water, alternately between 374 deg C. and 600 deg C., and alternately between 400 deg C. and 550 deg C.

Hot petroleum stream 40 and supercritical water stream 42 can be passed to mixer 230. Mixer 230 can be any type of mixing device capable of mixing a petroleum stream and a supercritical water stream. Examples of mixing devices suitable for use as mixer 230 can include a static mixer, an inline mixer, and impeller-embedded mixer. The ratio of the volumetric flow rate of hot petroleum stream 40 to supercritical water stream 42 can be between 1:10 and 10:1 at standard temperature and pressure (SATP), and alternately between 1:5 and 5:1 at SATP. Hot petroleum stream 40 and supercritical water stream 42 can be mixed to produce mixed feed 44. The pressure of mixed feed 44 can be greater than the critical pressure of water. The temperature of mixed feed 44 can depend on the temperatures of supercritical water stream 42 and hot petroleum stream 40. Mixed feed 44 can be introduced to supercritical water reactor 240.

Supercritical water reactor 240 can include one or more reactors in series. Supercritical water reactor 240 can be any type of reactor capable of allowing conversion reactions. Examples of reactors suitable for use in supercritical water reactor 240 can include tubular-type, vessel-type, CSTR-type, and combinations of the same. In at least one embodiment, supercritical water reactor 240 includes a tubular reactor, which advantageously prevents precipitation of reactants or products in the reactor. Supercritical water reactor 240 can include an upflow reactor, a downflow reactor, and a combination of an upflow reactor and downflow reactor. In at least one embodiment, supercritical water reactor 240 includes an upflow reactor, which advantageously prevents channeling of reactants resulting in an increased reaction yield. Supercritical water reactor 240 is in the absence of an external supply of catalyst. In at least one embodiment, supercritical water reactor 240 is in the absence of an external supply of hydrogen.

The temperature in supercritical water reactor 240 can be maintained at greater than the critical temperature of water, alternately in the range between 380 deg C. and 600 deg C., and alternately in the range between 390 deg C. and 450 deg C. The pressure in supercritical water reactor 240 can be maintained at a pressure in the range between 3203 pounds per square inch guage (psig) and 5150 psig and alternately in the range between 3300 psig and 4300 psig. The residence time of the reactants in supercritical water reactor 240 can between 10 seconds and 60 minutes and alternately between 1 minute and 30 minutes. The residence time is calculated by assuming that the density of the reactants in supercritical water reactor 240 is the same as the density of water at the operating conditions of supercritical water reactor 240.

The reactants in supercritical water reactor 240 can undergo conversion reactions to produce modified stream 50. Modified stream 50 can be introduced to cooling device 250.

Cooling device 250 can be any type of heat exchange device capable of reducing the temperature of modified stream 50. Examples of cooling device 250 can include double pipe type exchanger and shell-and-tube type exchanger. In at least one embodiment, cooling device 250 can be a cross exchanger with pressurized petroleum stream 8. The temperature of modified stream 50 can be reduced in cooling device 250 to produce cooled stream 60. The temperature of cooled stream 60 can be between 10 deg C. and 200 deg C. and alternately between 30 deg C. and 150 deg C. Cooled stream 60 can be introduced to depressurizing device 260.

Depressurizing device 260 can be any type of device capable of reducing the pressure of a fluid stream. Examples of depressurizing device 260 can include a pressure let-down valve, a pressure control valve, and a back pressure regulator. The pressure of cooled stream 60 can be reduced to produce discharged stream 70. Discharged stream 70 can be between 0 pounds per square inch gauge (psig) and 300 psig.

Discharged stream 70 can be introduced to gas-liquid separator 270. Gas-liquid separator 270 can be any type of separation device capable of separating a fluid stream into gas phase and liquid phase. Discharged stream 70 can be separated to produce product gas stream 24 and liquid phase stream 80. Liquid phase stream 80 can be introduced to oil-water separator 280.

Oil-water separator 280 can be any type of separation device capable of separating a fluid stream into a hydrocarbon containing stream and a water stream. Liquid phase stream 80 can be separated in oil-water separator 280 to produce product oil stream 26 and used water stream 28.

Figure 4:
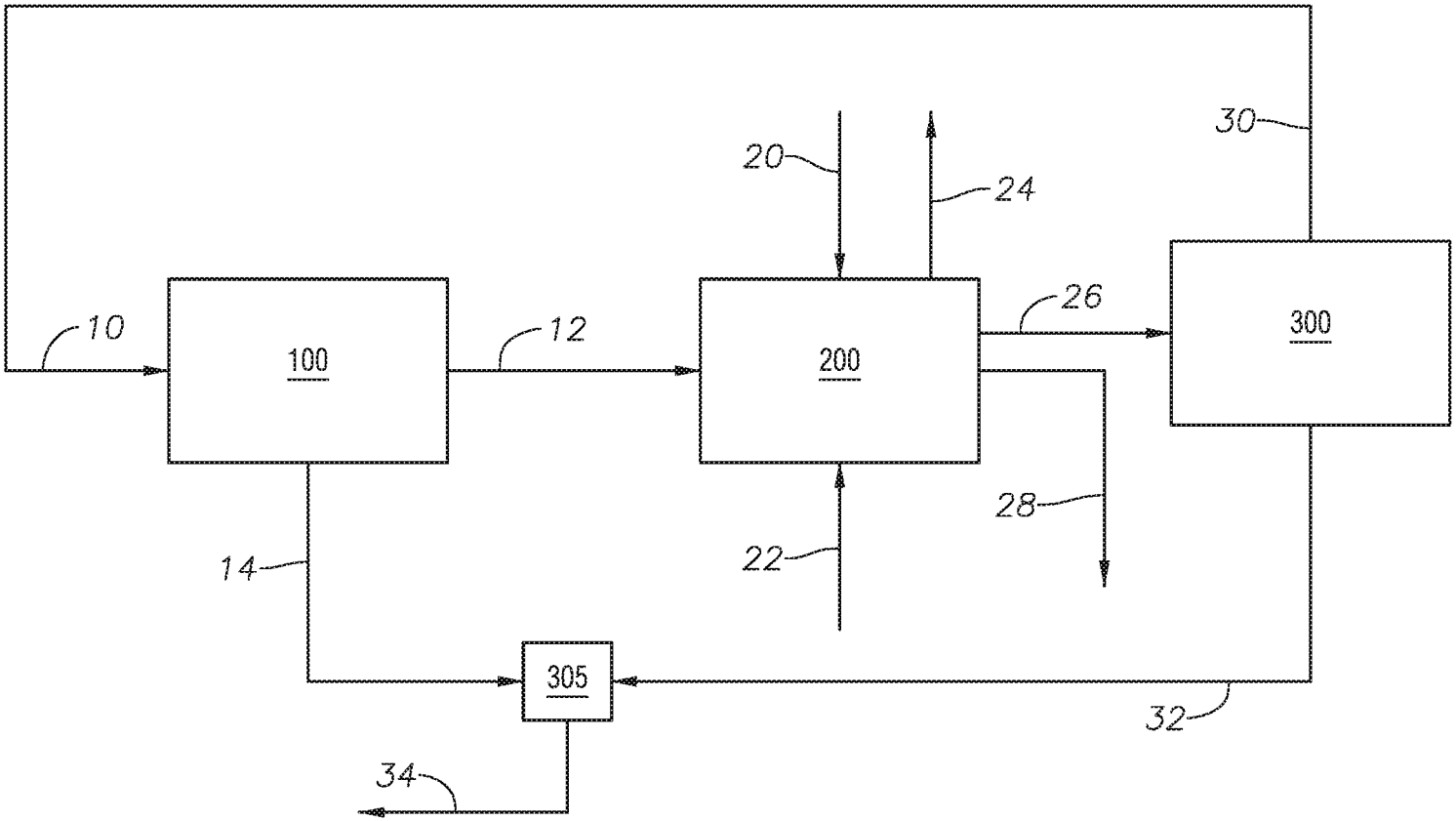
FIG. 4 provides a process diagram of an embodiment of the process.

An alternate embodiment is described with reference to FIG. 4, FIG. 1 and FIG. 3. Product oil stream 26 is introduced to fractionator 300. Fractionator 300 can be any type of separation device capable of separating a fluid stream. Product oil stream 26 can be separated into light fraction 30 and heavy fraction 32. Fractionator 300 can be designed to achieve specific properties in the light fraction and heavy fraction. Light fraction 30 can have a T95% of between 70 deg C. and 240 deg C. Heavy fraction 32 can contain the remaining compounds. Light fraction 30 can be introduced to disulfide oil unit 100 as disulfide oil unit feed 10. Heavy fraction 32 and sweetened light fraction 14 can be mixed in product mixer 305. Product mixer 305 can be any type of mixer capable of mixing two petroleum streams. Product mixer 305 can produce upgraded product oil 34. Upgraded product oil 34 can have an increased API gravity, reduced content of heteroatoms, such as sulfur, nitrogen, and metals, reduced content of asphalthene, and reduced viscosity.

In the supercritical upgrading process described here, the disulfides do not passivate the metal surfaces in the supercritical, but play a role in the reactions themselves as a radical initiator and source of hydrogen sulfide. Passivation occurs when metal is transformed to a metal sulfide. Passivation does not occur in supercritical water reactors due to the temperatures, which are lower than steam cracking in a pyrolysis furnace.

EXAMPLES

Examples. The Example was conducted by a lab scale unit with a system as shown in FIG. 2. Two runs were performed, one using a petroleum feedstock and a disulfide oil and the second using a petroleum feedstock in the absence of a disulfide oil.

For both runs, the petroleum feedstock was a deasphalted oil having a total sulfur content of 1.92 wt % sulfur. The water feed was an ASTM Type I water with a conductivity of less than 0.055 μS/cm. The disulfide oil in the first run was from a light naphtha processed in a Merox unit as the disulfide oil unit having the composition in Table 1.

TABLE 1

Composition of disulfide oil.

| Compounds | Concentration (wt %) |
|---|---|
| Dimethyl Disulfide | 10 |
| Methyl Ethyl Disulfide | 15 |
| Methyl Propyl Disulfide | 18 |
| Diethyl Disulfide | 7 |
| Ethyl Propyl Disulfide | 14 |
| Dipropyl Disulfide | 3 |
| Ethyl Dutrl Disulfide | 0 |
| Total | 67 |
| Sulfur Content | 55 |

In the first run, 100 parts by weight of the petroleum feedstock and 1.2 parts by weight disulfide oil was mixed in the petroleum mixer, a tank with an impeller, for 24 hours. The resulting mixed petroleum stream had a total sulfur content of 2.55% by weight, where 0.63% by weight was contributed by the disulfide oil. The volumetric flow rate at standard ambient temperature and pressure of the mixed petroleum stream was 0.7 liters per hour (L/hr). The volumetric flow rate at standard ambient temperature and pressure of the water feed was 1.5 L/hr.

The mixed petroleum stream was pressurized by a metering pump to 25 MPa and then heated to a temperature of 150 deg C. in a petroleum heater. The water feed was pressurized by a metering pump to 25 MPa and then heated to a temperature of 480 deg C. in a water heater. The heated mixed petroleum stream and the heated water feed was mixed in the mixer, a tee fitting with an internal diameter of 1.6 millimeters (mm), to produce the mixed feed.

The mixed feed was introduced to the supercritical water reactor. The supercritical water reactor was two reactors in series, the first in an upflow configuration and the second in a downflow configuration. The volume in each reactor was about 160 ml, an internal diameter of 20.2 mm and a length of 500 mm. The temperature of both reactors was set to 410 deg C., such that the temperature of the modified stream. The pressure of both reactors was maintained at 25 MPa by the depressurizing device. The reactors were non-isothermal.

The temperature of the modified stream was reduced in the cooling device, a double-pipe type heat exchanger, to a temperature of 90 deg C. in a cooled stream. The pressure of the cooled stream was reduced in the depressurizing device to the ambient pressure to produce the discharged stream.

The discharged stream was separated in the gas-liquid separator, a drum having a 500 ml internal volume, to produce the product gas stream and the liquid phase stream. The amount in the product gas stream was 2% by weight of the mixed petroleum stream. The liquid phase stream was separated in an oil-water separator, a centrifuge machine, to produce the product oil stream and the used water stream.

In the second run, the petroleum feedstock and the water were pre-heated and mixed and introduced to the upgrading system. The process conditions in each of the operating units were the same as in the first run.

The vacuum residue fraction of the product oil stream for each run was estimated using SIMDIS, an ASTM D 7169 method. The distillate fraction of the product oil stream for each run was estimated by SIMDIS, and ASTM D 7169 method. The properties of the product streams are in Table 2.

TABLE 2

Properties of Feed Streams and Product Streams

| Stream | Petroleum Feedstock | Product Oil Stream of Run 1 | Product Oil Stream of Run 2 |
|---|---|---|---|
| API Gravity | 21.5 | 29.9 | 23.1 |
| Total Sulfur Content (wt % sulfur) | 1.9% | 1.7% | 1.8% |
| Vacuum Residue Fraction | 66% | 43% | 54% |
| Distillate Fraction | 0% | 13% | 7% |

The results show that adding a small amount of disulfide oil, the upgrading of the petroleum feedstock was enhanced.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value and are inclusive unless otherwise indicated. When such a range is expressed, it is to be understood that another embodiment is from the one particular value to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made here.

As used here and in the appended claims, the words "comprise," "has," and "include" and all grammatical variations thereof are each intended to have an open, non-limiting meaning that does not exclude additional elements or steps.

That which is claimed is:

1. A method of upgrading a petroleum feedstock, the method comprising the steps of:

introducing a disulfide oil, a water feed, and the petroleum feedstock to a supercritical water upgrading unit, the disulfide oil comprising disulfides operable to enhance radical reactions and hydrogen transfer reactions of the petroleum feedstock in the supercritical water upgrading unit, wherein the disulfide oil comprises disulfides, wherein the disulfides comprise sulfur-containing compounds of the form Ci-SS-Cj, where C refers to carbon, where S refers to sulfur, where i is selected from 1, 2, 3, 4, 5, and 6, where 1 is selected from 1, 2, 3, 4, 5, and 6, wherein the disulfide oil comprises a total sulfur content of greater than 30% by weight; and operating the supercritical water upgrading unit to produce a product gas stream, a product oil stream, and a used water stream, wherein a supercritical water reactor of the supercritical water upgrading unit is operated at a temperature between 380 deg C. and 600 deg C. and a pressure in the range between 3203 psig and 5150 psig.

2. The method of claim 1, where the step of operating the supercritical water upgrading unit to produce the product gas stream, the product oil stream, and the used water stream comprises the steps of:

mixing the disulfide oil and the petroleum feedstock in a petroleum mixer to produce a mixed petroleum stream;

introducing the mixed petroleum stream to a petroleum pump;

increasing a pressure of the mixed petroleum stream to produce a pressurized petroleum stream;

introducing the pressurized petroleum stream to a petroleum heater;

increasing a temperature of the pressurized petroleum stream to produce a hot petroleum stream;

mixing the hot petroleum stream and a supercritical water stream to produce a mixed feed;

introducing the mixed feed to the supercritical water reactor;

allowing conversion reactions to occur in the supercritical water reactor to produce a modified stream;

introducing the modified stream to a cooling device;

reducing a temperature of the modified stream in the cooling device to produce a cooled stream;

introducing the cooled stream to a depressurizing device;

reducing the pressurizing in the depressurizing device to produce a discharged stream;

introducing the discharged stream to a gas-liquid separator;

separating the discharged stream in the gas-liquid separator to produce a product gas stream and a liquid phase stream;

introducing the liquid phase stream to an oil-water separator; and separating the liquid phase stream in the oil-water separator to produce the product oil stream and the used water stream.

3. The method of claim 1, further comprising the steps of:

introducing the product oil stream to a fractionator;

separating the product oil stream in the fractionator into a light fraction and a heavy fraction;

introducing the light fraction to a disulfide oil unit; and producing a sweetened light fraction and the disulfide oil in the disulfide oil unit.

4. The method of claim 3, where the disulfide oil unit is a merox unit.

5. The method of claim 3, further comprising the step of:

mixing the sweetened light fraction and the heavy fraction to produce an upgraded oil product.

6. The method of claim 1, further comprising the step of:

introducing a disulfide oil unit feed to a disulfide oil unit, where the disulfide oil unit feed is selected from the group consisting of natural gas, LPG, naphtha, and kerosene; and producing the disulfide oil in the disulfide oil unit, where the disulfide oil unit is a caustic extraction process.

7. The method of claim 1, where the petroleum feedstock is selected from the group consisting of an atmospheric residue, a vacuum residue, a vacuum gas oil, and a deasphalted oil.

8. The method of claim 1, where the disulfide oil comprises greater than 50% by weight disulfides.

9. The method of claim 1, where the product oil stream comprises an increased amount of upgraded hydrocarbons relative to the petroleum feedstock.

10. The method of claim 2, where a total sulfur content of the mixed petroleum stream is in the range from between 0.05% by weight to 3% by weight greater than the total sulfur content in the petroleum feedstock.

* * * * *